US012123697B1

(12) United States Patent
Ding et al.

(10) Patent No.: US 12,123,697 B1
(45) Date of Patent: Oct. 22, 2024

(54) CHARGING DEVICE AND CHARGING METHOD FOR OPEN PIT MINE ROCK PERFORATION BLASTING

(71) Applicant: CHINA UNIVERSITY OF MINING AND TECHNOLOGY, Xuzhou (CN)

(72) Inventors: Xiaohua Ding, Xuzhou (CN); Zhongao Yang, Xuzhou (CN); Zhouquan Liao, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 18/433,513

(22) Filed: Feb. 6, 2024

(30) Foreign Application Priority Data

Aug. 7, 2023 (CN) ..... 202310983234.1

(51) Int. Cl.
*F42D 1/08* (2006.01)
*F42D 1/22* (2006.01)
*F42D 3/04* (2006.01)

(52) U.S. Cl.
CPC ..... *F42D 1/08* (2013.01); *F42D 1/22* (2013.01); *F42D 3/04* (2013.01)

(58) Field of Classification Search
CPC ..... F42D 1/08; F42D 1/10; F42D 1/22; F42D 3/04; F42D 1/00
USPC ..... 102/301, 313, 319, 321, 323, 324
See application file for complete search history.

(56) References Cited

U.S. PATENT DOCUMENTS 3,064,572 A * 11/1962 Aitchison ..... F42B 3/087 149/46
3,696,703 A * 10/1972 Fox ..... F42D 1/10 86/20.15
4,285,399 A 8/1981 Holland et al.
7,331,291 B2 * 2/2008 Kang ..... F42D 1/20 102/311
2004/0200373 A1 * 10/2004 Robert ..... F42D 3/04 102/313

(Continued)

FOREIGN PATENT DOCUMENTS

CN 205808264 U 12/2016
CN 105674821 B * 8/2017 ..... F42D 1/08

(Continued)

OTHER PUBLICATIONS

Machine translation of CN 109506533 B (Year: 2024).*

(Continued)

*Primary Examiner* — James S Bergin

(57) ABSTRACT

The present invention discloses a charging device and method for open pit mine rock perforation blasting within the mining technology domain. The charging device includes a charging barrel with a detachable cover plate at the top and a bottom opening, housing a tray for explosive material. A jacking mechanism on the tray's side surface aids in positioning. A flexible interval gasbag separates the explosive and tray, with a wire passing hole at its center connected to an air pump via an inflation tube. A pressing plate and lifting mechanism in the cover plate facilitate lifting within the barrel. Additionally, a moving mechanism on the blast hole's top relocates the charging barrel. This innovation addresses challenges related to the cumbersome positioning and filling of existing powder explosives in open pit mine rock perforation blasting.

9 Claims, 4 Drawing Sheets

(56) References Cited

U.S. PATENT DOCUMENTS

| | | | |
|---|---|---|---|
| 2011/0094407 | A1 | 4/2011 | Fannon et al. |
| 2011/0277656 | A1 | 11/2011 | Escamilla |

FOREIGN PATENT DOCUMENTS

| | | | | | |
|---|---|---|---|---|---|
| CN | 109974546 | A | | 7/2019 | |
| CN | 111426245 | A | | 7/2020 | |
| CN | 213021276 | U | | 4/2021 | |
| CN | 214120952 | U | | 9/2021 | |
| CN | 217384017 | U | | 9/2022 | |
| CN | 218120775 | U | | 12/2022 | |
| CN | 115950317 | A | | 4/2023 | |
| CN | 109341452 | B | * | 10/2023 | ..... F42D 1/08 |
| CN | 109506533 | B | * | 1/2024 | ..... F42D 1/08 |
| KR | 20030021317 | A | | 3/2003 | |
| KR | 101022251 | B1 | | 3/2011 | |
| WO | 2020028952 | A1 | | 2/2020 | |

OTHER PUBLICATIONS

Machine translation of CN 109341452 B (Year: 2017).*
Machine translation of CN 105674821 B (Year: 2017).*
Authors: Liu Xiaoming, Shi Lingjie Title of Article: Application of New Combined Oil Phase Materials in the Production of ANFO Explosives Title of Book: Shanxi Coal Date:Mar. 15, 2023 pp. 8-12.
Authors:Ye Jianjun, Yin Zhong, Cheng Dachun, Han Xuejun, Wang Guohui, Peng Qingbo Title of Article: Review and prospect of decoupling charge structure of borehole Title of Book:Coal Mine Blasting Date:Aug. 2020 pp. 1-7.

* cited by examiner

CHARGING DEVICE AND CHARGING METHOD FOR OPEN PIT MINE ROCK PERFORATION BLASTING

TECHNICAL FIELD

The present invention relates to the field of mining technology, in particular to a charging device and charging method for open pit mine rock perforation blasting.

BACKGROUND ART

The common method of blasting in open pit mines is perforation blasting. First, the blast hole is excavated in the open pit mine, then the explosive is installed in the hole, and then the blasting is carried out. The methods of installing explosives in blast holes are continuous charging and interval charging. The air interval charging reduces the peak pressure of the explosion shock wave, reduces the overcrushing of the rock around the blast hole, prolongs the action time of the shock wave, and reduces the movement of the rock in the direction of the corresponding resistance line. Therefore, air interval charging is widely used in the blasting of open pit mines, and the middle air interval is more commonly used.

The existing central air interval blasting method is to directly fill the explosive into the blast hole, put it into the air spacer, and then load the explosive. This way of loading explosives is more convenient for solid explosive packs, but for granular explosives, due to their relatively small size and unfixed shape in a flowing state, and the air spacer cannot support them well, which cannot achieve the positioning of granular explosives and affect the blasting effect. The granular explosive is directly poured into the blast hole, which makes it easy to produce more dust and the working environment is relatively poor.

SUMMARY

An objective of the present invention is to provide a charging device for open pit mine rock perforation blasting, which solves the problem that the existing powder explosive is not easy to locate and is not convenient to fill. Another objective of the present invention is to provide a charging method of a charging device for open pit mine rock perforation blasting.

In order to achieve the above objective, the present invention provides a charging device for open pit mine rock perforation blasting, comprising a charging barrel, a bottom opening of the charging barrel, and a top is provided with a detachable cover plate; the interior of the charging barrel is provided with a first tray and a second tray for containing explosive, and a jacking mechanism is provided on a side surface of the first tray and a second tray; a flexible interval gasbag is provided between the explosive and the second tray above the explosive, a wire passing second hole is provided through the centre of the interval gasbag to facilitate the passage of the detonating cord and the inflation tube, an air inlet is provided on the wire passing second hole to facilitate the inflation into the interval gasbag, and the air inlet is connected to the air pump via a inflation tube; the upper part of the charging barrel is provided with a pressing plate, and the cover plate is provided with a lifting mechanism for driving the pressing plate to lift in the charging barrel; the top of the blast hole is provided with a moving mechanism for moving the charging barrel in the blast hole.

Preferably, the jacking mechanism comprises an arc-shaped top plate, an annular mounting groove is provided on a side surface of the first tray and the second tray, the top plate is slidably provided in the mounting groove, and a spring is provided between the top plate and the mounting groove; adjacent top plates are connected via a flexible connection part.

Preferably, a limiting plate is provided on the end of the top plate, and a transverse sawtooth-shaped anti-skid stripe is provided on a side surface of the limiting plate; the lower part of the limiting block is provided with an inwardly inclined slope.

Preferably, the first tray at the bottom of the charging barrel is provided with a seeker at its bottom, and the second tray at the middle of the charging barrel is provided with a wire passing first hole in its center to facilitate the passage of the detonating cord and the inflation tube.

Preferably, the interior of the interval gasbag is horizontally provided with several interlayers, the interlayers divide the interval gasbag into several gas chambers, each gas chamber is provided with an air inlet, a check valve is provided at the air inlet, and the interior of the interlayers is filled with a toxic gas inhibitor; the bottom of the interval gasbag has a convex cambered configuration.

Preferably, the lifting mechanism comprises a worm, the bottom end of the worm is connected to a connection seat provided on the upper surface of the pressing plate, a through hole is provided on the cover plate for the worm to pass through, a worm wheel engaged with the worm is provided on the cover plate, a protective box is provided on the outside of the worm and the worm wheel, and a central shaft of the worm is connected to a motor.

Preferably, the protective box is provided with a through hole for the worm to pass through, and a sleeve protruding from the protection box is provided at the through hole.

Preferably, a limiting structure for limiting the pressing plate is provided inside the charging barrel, the limiting structure comprises a sliding groove provided along the length direction of the charging barrel, the sliding groove is located on the inner surface of the charging barrel, and a sliding block adapted to the sliding groove is provided on the pressing plate.

Preferably, the moving mechanism comprises a support frame, the support frame is placed on the rock at the top edge of the blast hole, the support frame is provided with a hoist, and the hoist is connected to a lifting lug provided on the charging barrel via a traction rope, and the top of the support frame is provided with a pulley guiding the traction rope.

A charging method of a charging device for open pit mine rock perforation blasting, comprising the steps of:

S1, removing the cover plate of the charging barrel, loading the first tray located at the bottom from the top of the charging barrel, pushing the first tray downward to load the explosive above the first tray located at the bottom of the charging barrel, then placing the uninflated interval gasbag into the charging barrel from the top of the charging barrel, then placing the second tray located in the middle from the top of the charging barrel, and loading the explosive, leading the detonating cord in the explosive and the inflation tube of the interval gasbag upward to the top of the charging barrel from the wire passing first hole and the wire passing second hole, and the inflation tube passing out from the tube hole on the cover plate to be connected to the air pump; after completing the filling, fixing the cover plate on the top of the charging barrel;

S2, placing the charging barrel into the blast hole, fixing the traction rope on the lifting lug of the charging barrel, starting the hoist, elongating the traction rope, and lowering the charging barrel to the bottom of the blast hole;

S3, starting the motor, the motor driving the worm wheel to rotate, and the worm driving the pressing plate to move downwards; meanwhile, the hoist reverses to lift the charging barrel upwards, the first tray located at the bottom of the charging barrel sliding out from the bottom of the charging barrel, the top plate on the first tray springing out under the action of the spring, and relies on the anti-skid stripe on the limiting plate to bear against the hole wall of the blast hole, and meanwhile, expanding the flexible connection part to support the explosive; with the lifting of the charging barrel, the explosive in the charging barrel falls on the first tray under the action of gravity;

S4, pushing the interval gasbag out of the charging barrel under the action of the pressing plate, stopping the motor, starting the air pump, the air pump inflating the interval gasbag through the inflation tube, and the charging barrel continuously rising;

S5, after completing the inflation of the interval gasbag, starting the motor, the pressing plate pushing the second tray out of the charging barrel, fixing the second tray on the hole wall of the blast hole, and as the pressing plate continues to push, the charging barrel continues to rise, the explosive is falling on the second tray, and the pressing plate continues to descend to compact the explosive;

S6, after completing the the explosive filling, taking out the charging barrel from the blast hole; filling and blocking the opening of the blast hole for blasting.

The advantages and positive effects of the charging device and charging method for open pit mine rock perforation blasting described in the present invention are as follows:

1, providing trays, explosives, and interval gasbags on the inside of the charging barrel, without exposing the explosives to the outside during the filling process, is advantageous for reducing dust.

2, using an interval gasbag at the spacing between the explosives, which takes up less space in the uninflated condition and is beneficial to reduce the volume of the charging barrel. In addition, realizing the placement of the interval gasbags under the action of the charging barrel, and the placement of the interval gasbags is accurate. After inflating the interval gasbag, it is in close contact with the inner wall of the blast hole, and the arc surface structure at the bottom of the interval gasbag has a compaction effect on the explosive below the interval gasbag, which is beneficial to improve the blasting effect.

3, using the tray for supporting the explosive, the top plate provided on the tray is beneficial to improve the stability of the tray support, and the interval gasbags also have the function of supporting the tray above, and the spacing of the explosive can be ensured. The flexible connection part between the top plates of the tray can effectively prevent the falling of the explosive, which is beneficial to improve the blasting effect.

4, providing a toxic gas inhibitor within the interval gasbag helps to reduce toxic gas spillage during blasting.

Further detailed descriptions of the technical scheme of the present invention can be found in the accompanying drawings and examples.

DRAWING MARKS

1, a charging barrel; 2, a first tray; 3, an interval gasbag; 4, an explosive; 5, a pressing plate; 6, a worm; 7, a worm wheel; 8, a protective box; 9, a sleeve; 10, cover plate; 11, a sliding block; 12, a connection seat; 13, a sliding groove; 14, a lifting lug; 15, a toxic gas inhibitor; 16, a seeker; 17, an anti-skid stripe; 18, a top plate; 19, a flexible connection part; 20, a wire passing first hole; 21, a spring; 22, an mounting groove; 23, a limiting plate; 24, a gas chamber; 25, a wire passing second hole; 26, an air inlet; 27, a blast hole; 28, a support frame; 29, a hoist; 30, a traction rope; 31, a second tray

DETAILED DESCRIPTION OF THE EMBODIMENTS

The technical solution of the present invention will be further elaborated hereafter in conjunction with accompanying drawings and examples.

Unless otherwise defined, the technical terms or scientific terms used in the invention should be understood by people with general skills in the field to which the invention belongs. The words 'first', 'second', and the like used in this invention do not represent any order, quantity, or importance, but are only used to distinguish different components. Similar words such as 'include' or 'comprise' mean that the elements or objects appearing before the word cover the elements or objects listed after the word and their equivalents, without excluding other elements or objects. Similar words such as 'connected' or 'linked' are not limited to physical or mechanical connections, but can include electrical connections, whether direct or indirect. 'Up', 'down', 'left', 'right', etc. are only used to represent the relative positional relationship. When the absolute position of the described object changes, the relative positional relationship may also change accordingly.

Example

Figure 1:
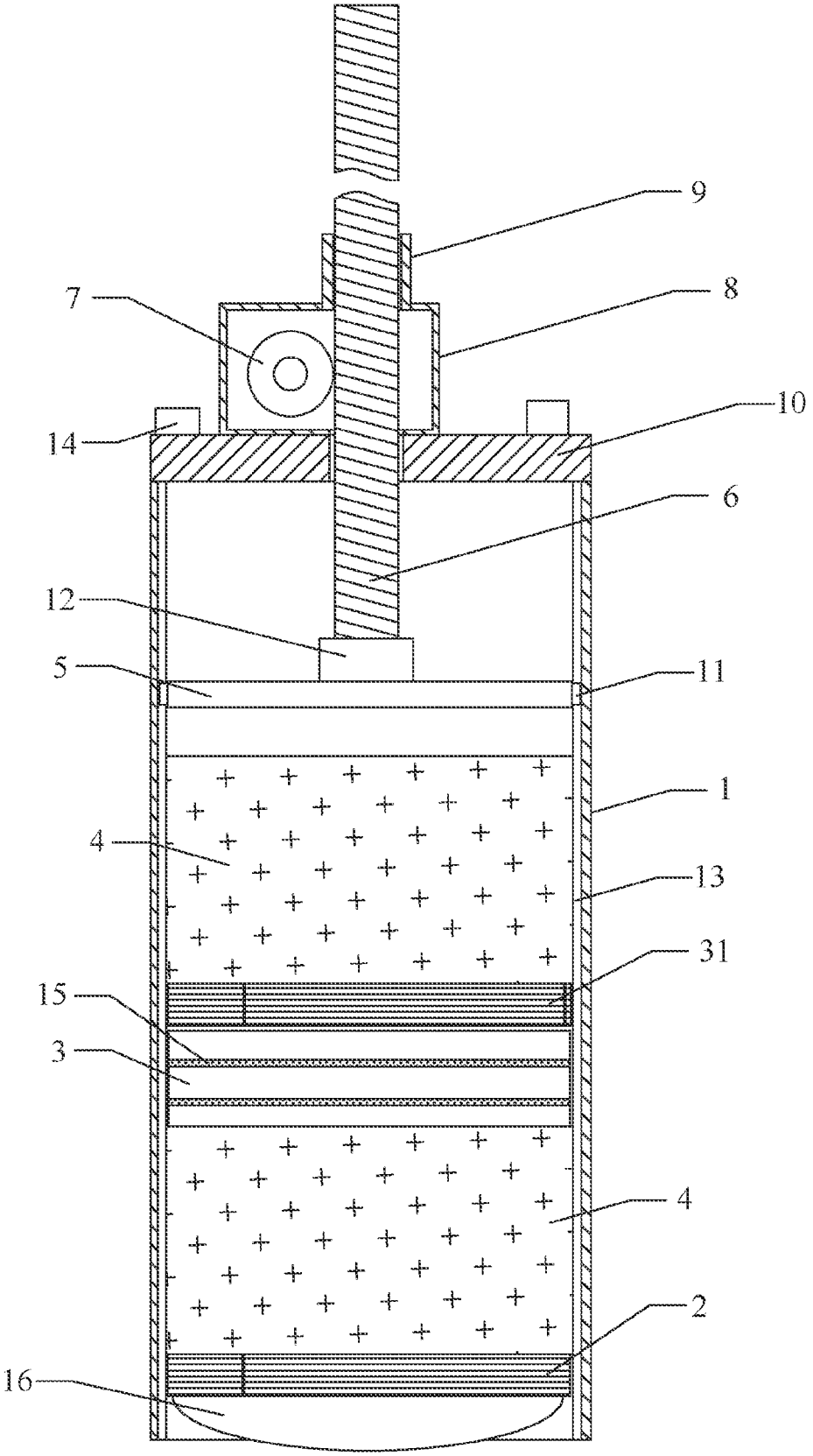
FIG. 1 is a structural schematic diagram of an embodiment of a charging device and charging method for open pit mine rock perforation blasting of the present invention.
Figure 2:
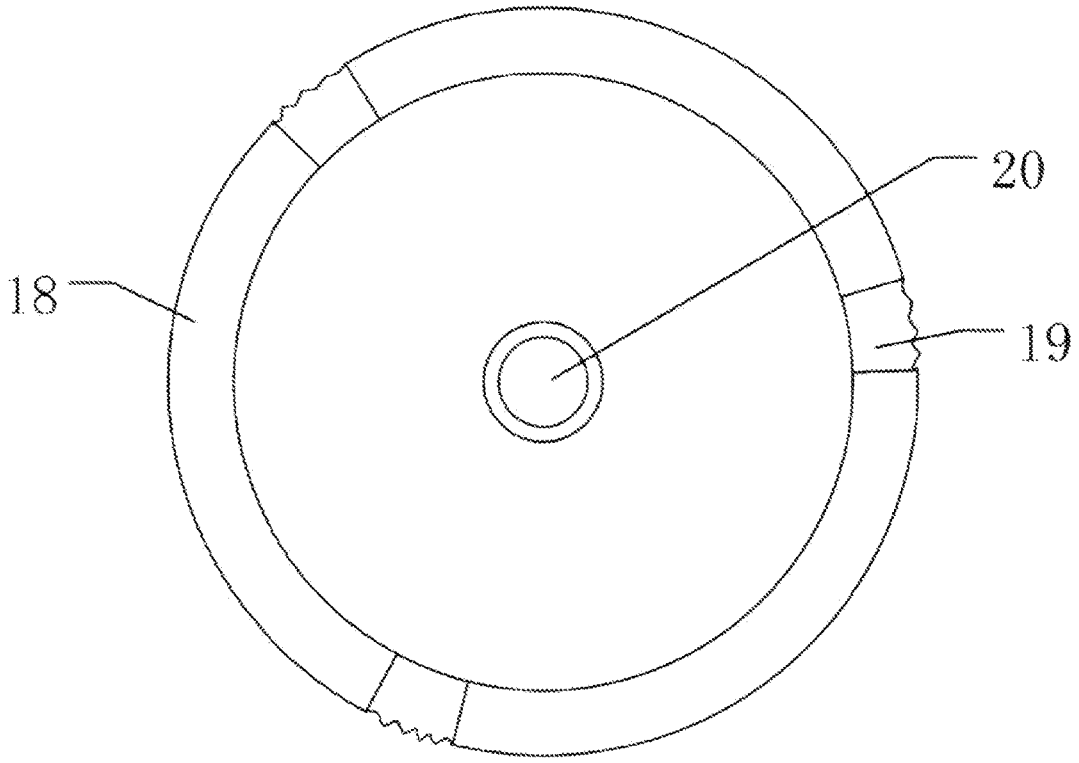
FIG. 2 is a tray expansion overlooking structural schematic diagram of an embodiment of a charging device and charging method for open pit mine rock perforation blasting of the present invention.
Figure 3:
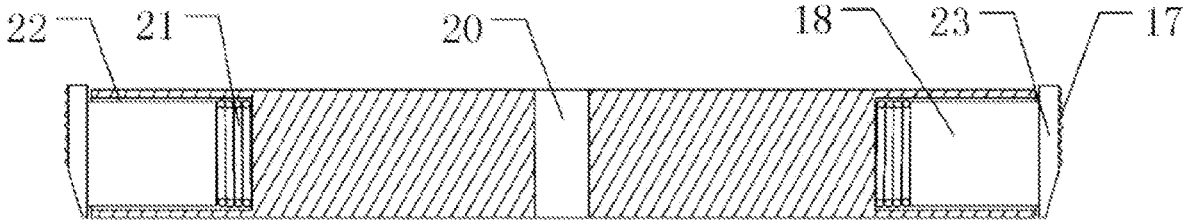
FIG. 3 is a tray section structural schematic diagram of an embodiment of a charging device and charging method for open pit mine rock perforation blasting of the present invention.
Figure 4:
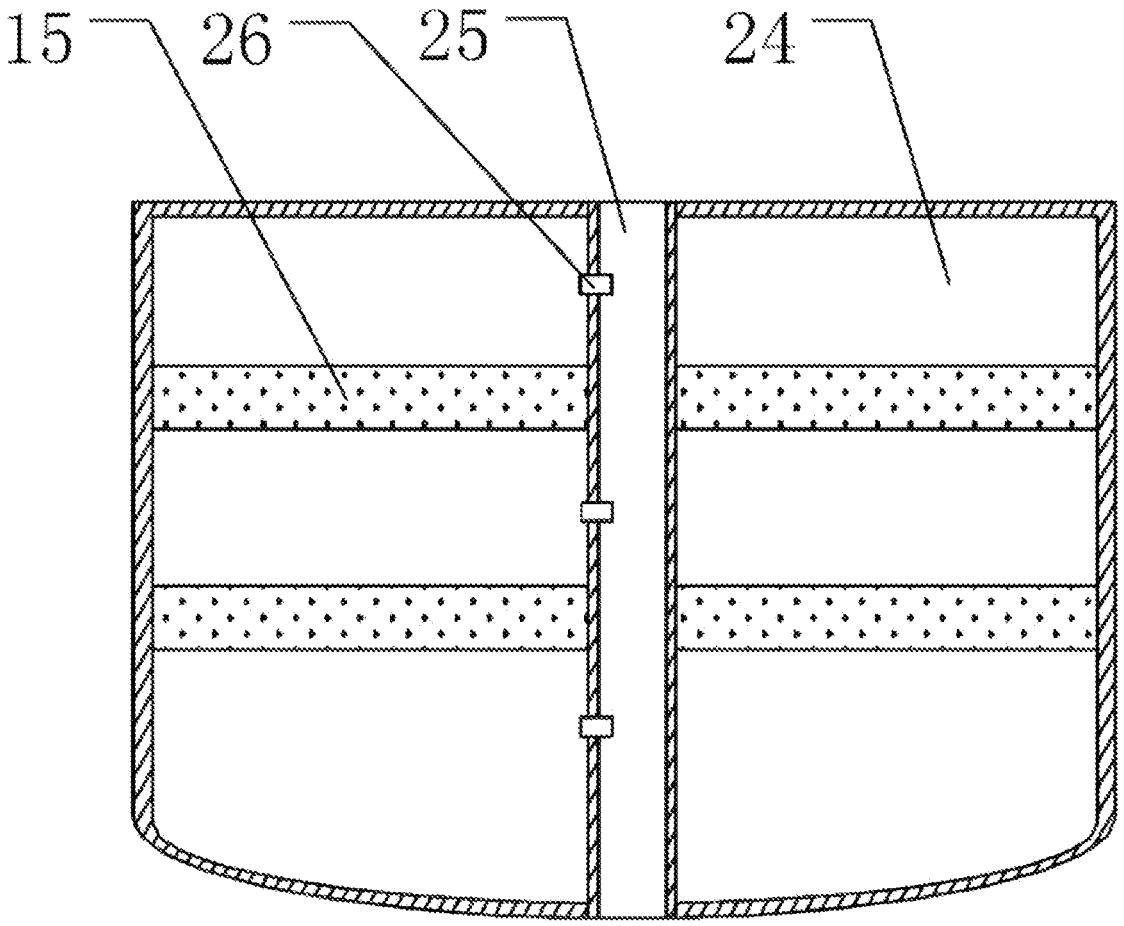
FIG. 4 is an interval gasbag section structural schematic diagram of an embodiment of a charging device and charging method for open pit mine rock perforation blasting of the present invention.
Figure 5:
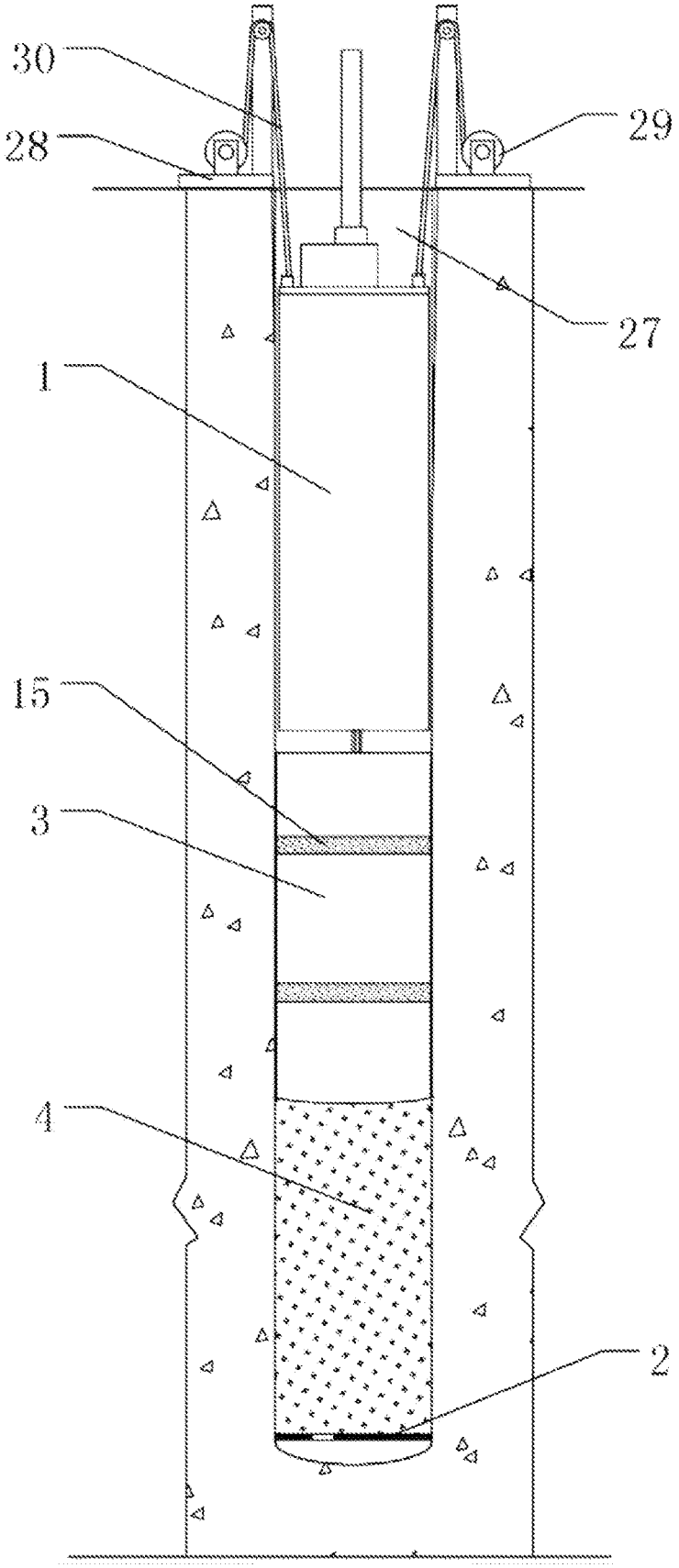
FIG. 5 is a use state structural schematic diagram of an embodiment of a charging device and charging method for open pit mine rock perforation blasting of the present invention.

As shown in FIGS. 1-5. A charging device for open pit mine rock perforation blasting, comprising a charging barrel 1, the charging barrel 1 is a cylindrical structure, and the outer diameter of the charging barrel 1 is slightly smaller than the aperture of the blast hole 27, so that the charging barrel 1 can move up and down within the blast hole 27. A bottom opening of the charging barrel 1, and a top is provided with a detachable cover plate 10. The cover plate 10 and the charging barrel 1 are connected via bolt disassembly or the existing buckle structure, as long as the disassembly of the cover plate 10 and the charging barrel 1 can be realized.

The interior of charging barrel 1 is provided with a first tray 2 and a second tray 31 for containing explosive 4, the first tray 2 and a second tray 31 are disc-shaped structure, the diameter of the first tray 2 and the second tray 31 is slightly smaller than the inner diameter of the charging barrel 1, so that the first tray 2 and the second tray 31 can be loaded into the charging barrel 1. A jacking mechanism is provided on a side surface of the first tray 2 and the second tray 31. The jacking mechanism comprises an arc-shaped top plate 18, an annular mounting groove 22 is provided on a side surface of the first tray 2 and the second tray 31, the top plate 18 is slidably provided in the mounting groove 22. A spring 21 is provided between the top plate 18 and the mounting groove 22, the spring 21 is evenly distributed on the top plate 18, and the spring 21 ejects the top plate 18 from the mounting groove 22. Adjacent top plates 18 are connected via a flexible connection part 19, the flexible connection part can be plastic film or cloth film, the purpose is to insert the top plate 18 into the mounting groove 22, and the flexible connection part 19 is spread out after the top plate 18 is unfolded to form a complete disc structure to support the explosive 4 and avoid the explosive 4 falling from the gap of the top plate 18.

A limiting plate 23 is provided on the end of the top plate 18, and the limiting plate 23 is integrated with the top plate 18. A transverse sawtooth-shaped anti-skid stripe 17 is provided on a side surface of the limiting plate 23, which is beneficial to improve the friction between the limiting plate 23 and the hole wall of the charging barrel 1 and the blast hole 27, and improve the support effect of the tray 2. The lower part of the limiting block is provided with an inwardly inclined slope, which is convenient for loading the first tray 2 and the second tray 31 into the charging barrel 1.

The first tray 2 at the bottom of the charging barrel 1 is provided with a seeker 16 at its bottom, which is convenient for loading the charging barrel 1 into the blast hole 27. The second tray 31 at the middle of the charging barrel 1 is provided with a wire passing first hole 20 in its center, the wire passing first hole 20 facilitates the passage of the detonating cord and the inflation tube.

A flexible interval gasbag 3 is provided between the explosive 4 and the second tray 31 above the explosive. The interval gasbag 3 is made of PVC film, which has a good sealing effect. After inflating, the interval gasbag 3 expands to act to space adjacent explosive 4. And the flexible interval gasbag 3 can be in close contact with the hole wall of the blast hole 27. A wire passing second hole 25 is provided through the center of the interval gasbag, the wire passing second hole 25 facilitates the passage of the detonating cord and the inflation tube.

The interior of the interval gasbag 3 is horizontally provided with several interlayers, the interlayers divide the interval gasbag 3 into several closed gas chambers 24. Each gas chamber 24 is provided with an air inlet 26, the air inlet 26 is located in the wire passing second hole. A check valve is provided at the air inlet, and the inflation tube is connected to the air inlet 26, and the gas chamber 24 is inflated via the air pump. The inflation tube and the air inlet 26 can be connected in a plug-in way, after the inflation is completed, the inflation tube is pulled off from the air inlet 26 and the inflatable tube is recovered. The interior of the interlayers is filled with a toxic gas inhibitor 15, with the blasting, the interval gasbag 3 is broken, and the toxic gas inhibitor 15 is dispersed, which suppresses the toxic gas produced by the blasting and reduces the release of toxic gas. The bottom of the interval gasbag 3 has a convex cambered configuration, after the interval gasbag 3 is inflated, it is pressed on the lower explosive 4, and the explosive 4 is compacted and fully contacted with the blast hole 27, which is beneficial to improve the blasting effect.

The upper part of the charging barrel 1 is provided with a pressing plate 5, and the cover plate 10 is provided with a lifting mechanism for driving the pressing plate 5 to lift in the charging barrel 1. The lifting mechanism comprises a worm 6, and the bottom end of the worm 6 is connected to a connection seat 12 provided on the upper surface of the pressing plate 5. A through hole is provided on the cover plate 10 for the worm 6 to pass through, a worm wheel 7 engaged with the worm 6 is provided on the cover plate 10, and a central shaft of the worm 6 is connected to a motor. A protective box 8 is provided on the outside of the worm 6 and the worm wheel 7, the protective box 8 is provided with a through hole for the worm 6 to pass through, and a sleeve 9 protruding from the protective box 8 is provided at the through the hole. The central shaft of worm 6 is connected with the protective box 8 through bearing rotation. The motor drives the worm wheel 7 to rotate, and the worm wheel 7 engages with the worm 6, so that the worm 6 moves up and down, and the pressing plate 5 moves up and down. Through the pressing plate 5, the explosive 4, the second tray 31 and the interval gasbag 3 filled in the charging barrel 1 are pushed out to the blast hole 27.

A limiting structure for limiting the pressing plate 5 is provided inside the charging barrel 1. The limiting structure comprises a sliding groove 13 provided along the length direction of the charging barrel 1, the sliding groove 13 is located on the inner surface of the charging barrel 1, and a sliding block 11 adapted to the sliding groove 13 is provided on the pressing plate 5, the sliding block 11 is located in the sliding groove 13 and slides along the sliding groove 13. There are at least two sliding grooves 13 on the inner wall of the charging barrel 1. The sliding groove 13 and the sliding block 11 are beneficial to maintain the stability of the worm 6 moving up and down.

The top of the blast hole 27 is provided with a moving mechanism for moving the charging barrel 1 in the blast hole 27. The moving mechanism comprises a support frame 28, the support frame 28 is placed on the rock at the top edge of the blast hole 27. At least two support frames 28 are set up, and the support frame 28 is evenly set on the edge of the blast hole 27, thereby improving the uniformity of the movement of the charging barrel 1. The support frame 28 is provided with a hoist 29, the hoist 29 is connected to a lifting lug 14 provided on the charging barrel 1 via a traction rope 30. The top of the support frame 28 is provided with a pulley guiding the traction rope 30. The traction rope 30 can choose the wire rope, which has high strength and good wear resistance. The hoist 29 drives the charging barrel 1 to move in the blast hole 27 through the retraction and release of the traction rope 30.

A plurality of interval gasbags 3 can be provided in the charging barrel 1 according to needs, wherein the interval gasbags 3 are provided with independent inflation tubes, and the inflation tubes of the interval gasbags 3 protrude from the wire passing first hole 20 and the wire passing second hole 25, and can respectively inflate the interval gasbags 3 via the inflation tubes.

A charging method of a charging device for open pit mine rock perforation blasting, comprising the steps of:

S1, the cover plate 10 of the charging barrel 1 is removed, the first tray 2 located at the bottom is loaded from the top of the charging barrel 1, the first tray 2 is pushed downward to load the calculated quantity of explosive 4 above the first tray 2 located at the bottom in the charging barrel 1; under the action of spring 21, the limiting plate 23 of the first tray 2 is pressed on the inner wall of the charging barrel 1 to avoid the first tray 2 from slipping out of the charging barrel 1 easily.

Then the uninflated interval gasbag 3 is placed into the charging barrel 1 from the top of the charging barrel 1, then the second tray 31 located in the middle is placed from the top of the charging barrel 1, and load the explosive 4.

The detonating cord in the explosive 4 and the inflation tube of the interval gasbag 3 are led upward to the top of the charging barrel 1 from the wire passing first hole 20 and the wire passing second hole 25, the pressing plate 5 is provided with a through hole for the detonating cord and the inflatable tube to pass through, and the inflation tube is passed out from the tube hole on the cover plate 10 to be connected to the air pump. The length of the inflation tube and the detonating cord should be calculated in advance, and folded and placed in the wire passing first hole 20 or the wire passing second hole 25 to meet the needs of the length of the inflation tube and the detonating cord after the expansion of the interval gasbag 3.

After the filling is completed, the cover plate 10 is fixed on the top of the charging barrel 1.

S2, the charging barrel 1 is placed into the blast hole 27, the traction rope 30 is fixed on the lifting lug 14 of the charging barrel 1, the hoist 29 is started, the traction rope 30 is elongated, and under the action of the gravity of the charging barrel 1 itself, lower the charging barrel 1 to the bottom of the blast hole 27.

S3, the motor is started, the motor drives the worm wheel to rotate, and the worm 6 drives the pressing plate 5 to move downwards. Meanwhile, the hoist 29 reverses to lift the charging barrel 1 upwards. The first tray 2 located at the bottom of the charging barrel 1 slides out from the bottom opening of the charging barrel 1, the top plate 18 on the first tray 2 springs out under the action of the spring 21, and relies on the anti-skid stripe 17 on the limiting plate 23 to bear against the hole wall of the blast hole 27, and meanwhile, the flexible connection part 19 is expanded to support the explosive 4. With the lifting of the charging barrel 1, the explosive 4 in the charging barrel 1 falls on the first tray 2 under the action of gravity.

S4, the interval gasbag 3 is pushed out of the charging barrel 1 under the action of the pressing plate 5, the motor is stopped, the pressing plate 5 stops moving to start the air pump, and the air pump inflates the interval gasbag 3 through the inflation tube, the interval gasbag 3 expands, and the charging barrel 1 continuously rising.

S5, after the inflation of the interval gasbag 3 is completed, the motor is started, the pressing plate 5 pushes the second tray 31 out of the charging barrel 1, and the second tray 31 is fixed on the hole wall of the blast hole 27. As the pressing plate 5 continues to push, the charging barrel 1 continues to rise, the explosive 4 falls on the middle second tray 31, and the pressing plate 5 continues to descend to compact the explosive 4;

S6, after the the explosive 4 filling is completed, the charging barrel 1 is taken out from the blast hole 27; the opening of the blast hole 27 is filled and blocked for blasting.

Therefore, the present invention adopts a charging device for open pit mine rock perforation blasting, which solves the problem that the existing powder explosive is not easy to locate and is not convenient to fill.

Finally, it should be noted that the above examples are merely used for describing the technical solutions of the present invention, rather than limiting the same. Although the present invention has been described in detail with reference to the preferred examples, those of ordinary skill in the art should understand that the technical solutions of the present invention may still be modified or equivalently replaced. However, these modifications or substitutions should not make the modified technical solutions deviate from the spirit and scope of the technical solutions of the present invention.

What is claimed is:

1. A charging device for open pit mine rock perforation blasting, comprising:

a charging barrel with a bottom opening and a top, wherein the top is provided with a detachable cover plate; and a first tray and a second tray, wherein, an interior of the charging barrel is provided with the first tray and the second tray for containing explosive;

the first tray is disposed towards bottom of the charging barrel, wherein the first tray is provided with a seeker;

the second tray is provided with a wire passing first hole in the center to facilitate the passage of a detonating cord and an inflation tube; and a jacking mechanism is provided on a side surface of the first tray and the second tray;

a flexible interval gasbag is provided between the explosive contained on the first tray, and the second tray, wherein, a wire passing second hole is provided through the centre of the flexible interval gasbag to facilitate the passage of the detonating cord and the inflation tube;

an air inlet is provided on the wire passing second hole to facilitate the inflation into the flexible interval gasbag; and the air inlet is connected to an air pump via the inflation tube;

a pressing plate is provided towards an upper part of the charging barrel, wherein, the detachable cover plate is provided with a lifting mechanism for driving the pressing plate to be liftable in the charging barrel; and a top of a blast hole is provided with a moving mechanism for moving the charging barrel in the blast hole.

2. The charging device for open pit mine rock perforation blasting according to claim 1, wherein the jacking mechanism comprises:

an arc-shaped top plate, an annular mounting groove provided on a side surface of the second tray, wherein, the top plate is slidably provided in the mounting groove;

a spring is provided between the top plate and the mounting groove; and adjacent top plates are connected via a flexible connection part.

3. The charging device for open pit mine rock perforation blasting according to claim 2, wherein, a limiting plate is provided on the end of the top plate, and a transverse sawtooth-shaped anti-skid stripe is provided on a side surface of the limiting plate; and the lower part of a limiting block is provided with an inwardly inclined slope.

4. The charging device for open pit mine rock perforation blasting according to claim 3, wherein, the interior of the interval gasbag is provided with several gas chambers, wherein the gas chambers are defined by several horizontally provided interlayers;

each gas chamber is provided with an air inlet, and a check valve is provided at the air inlet;

interior of the interlayers are configured to be filled with a toxic gas inhibitor; and the bottom of the flexible interval gasbag has a convex cambered configuration.

5. The charging device for open pit mine rock perforation blasting according to claim 4, wherein the lifting mechanism comprises a worm, wherein, the bottom end of the worm is connected to a connection seat provided on the upper surface of the pressing plate;

a through hole is provided on the cover plate for the worm to pass through;

a worm wheel engaged with the worm is provided on the cover plate, a protective box is provided on the outside of the worm and the worm wheel, and a central shaft of the worm is connected to a motor.

6. The charging device for open pit mine rock perforation blasting according to claim 5, wherein the protective box is provided with a through hole for the worm to pass through, and a sleeve protruding from the protective box is provided at the through hole.

7. The charging device for open pit mine rock perforation blasting according to claim 6, wherein, a limiting structure for limiting the pressing plate is provided inside the charging barrel;

the limiting structure comprises a sliding groove provided along the length direction of the charging barrel;

the sliding groove is located on an inner surface of the charging barrel; and a sliding block adapted to the sliding groove is provided on the pressing plate.

8. The charging device for open pit mine rock perforation blasting according to claim 7, wherein, the moving mechanism comprises a support frame;

the support frame is placed on a rock at the top edge of the blast hole;

the support frame is provided with a hoist;

the hoist is connected to a lifting lug provided on the charging barrel via a traction rope; and the top of the support frame is provided with a pulley guiding the traction rope.

9. A charging method of a charging device for open pit mine rock perforation blasting according to claim 8, comprising the steps of:

removing the cover plate of the charging barrel, loading the first tray located at the bottom from the top of the charging barrel, pushing the first tray downward to load the explosive above the first tray located at the bottom of the charging barrel, then placing the uninflated flexible interval gasbag into the charging barrel from the top of the charging barrel, then placing the second tray located in the middle from the top of the charging barrel, and loading the explosive, leading the detonating cord in the explosive and the inflation tube of the flexible interval gasbag upward to the top of the charging barrel from the wire passing first hole and the wire passing second hole, and the inflation tube passing out from a tube hole on the detachable cover plate to be connected to the air pump; after completing the filling, fixing the detachable cover plate on the top of the charging barrel;

placing the charging barrel into the blast hole, fixing the traction rope on the lifting lug of the charging barrel, starting the hoist, elongating the traction rope, and lowering the charging barrel to the bottom of the blast hole;

starting the motor, the motor driving the worm wheel to rotate, and the worm driving the pressing plate to move downwards; meanwhile, the hoist reverses to lift the charging barrel upwards, the tray located at the bottom of the charging barrel sliding out from the bottom of the charging barrel, the top plate on the tray springing out under the action of the spring, and relies on the anti-skid stripe on the limiting plate to bear against the hole wall of the blast hole, and meanwhile, expanding the flexible connection part to support the explosive; with the lifting of the charging barrel, the explosive in the charging barrel falls on the tray under the action of gravity;

pushing the flexible interval gasbag out of the charging barrel under the action of the pressing plate, stopping the motor, starting the air pump, the air pump inflating the flexible interval gasbag through the inflation tube, and the charging barrel continuously rising;

starting the motor after completing the inflation of the interval gasbag, the pressing plate pushing the second tray out of the charging barrel, fixing the second tray on the hole wall of the blast hole, and as the pressing plate continues to push, the charging barrel continues to rise, the explosive is falling on the second tray, and the pressing plate continues to descend to compact the explosive;

taking out the charging barrel from the blast hole after completing the explosive filling; and filling and blocking the opening of the blast hole for blasting.

* * * * *